US005969690A

United States Patent [19]

Yamabayashi et al.

[11] Patent Number: 5,969,690

[45] Date of Patent: Oct. 19, 1999

[54] MOBILE RADIO ANTENNA

[75] Inventors: Masaaki Yamabayashi, Tsuyama; Koichi Ogawa; Naoki Yuda, both of Hirakata, all of Japan

[73] Assignee: Matsushita Electric Industrial Co., Ltd., Osaka, Japan

[21] Appl. No.: 08/896,976

[22] Filed: Jul. 18, 1997

[30] Foreign Application Priority Data

Jul. 18, 1996 [JP] Japan ..... 8-189598

[51] Int. Cl.[6] ..... H01Q 19/00

[52] U.S. Cl. ..... 343/792; 343/817; 343/818; 343/833

[58] Field of Search ..... 343/792, 817, 343/818, 833, 810, 819, 827, 890, 891, 892, 790, 791, 813, 815

[56] References Cited

U.S. PATENT DOCUMENTS 3,790,943 2/1974 Pickles et al. ..... 343/791

5,506,591 4/1996 Dienes ..... 343/792

5,539,419 7/1996 Ogawa et al. ..... 343/790

*Primary Examiner*—Hoanganh Le

*Attorney, Agent, or Firm*—Smith, Gambrell & Russell

[57] ABSTRACT

Although conventional antennas have characteristics suitable for mobile radio base stations, their vertical dimension is large, and locations of their installation are limited. A radiator for an first upper antenna 32 is arranged in a hollow nonconductive radome 2, using an internal conductor 7a and a metal pipe 10. A radiator for a second lower antenna 34 is arranged in the radome 2, using metal pipes 14 and 15. Two parasitic elements 31 are installed substantially in parallel with the first antenna 32 below a feeding point 9. Two parasitic elements 33 are installed substantially in parallel with the second antenna 34 above a feeding point 13. These allow the tilt angle to be freely set between −10° and +10° by adjusting the parasitic element length and the antenna to be reduced in size.

26 Claims, 21 Drawing Sheets

Fig. 4(a) CURRENT DISTRIBUTIONS FOR DIFFERENT PE DIAMETERS
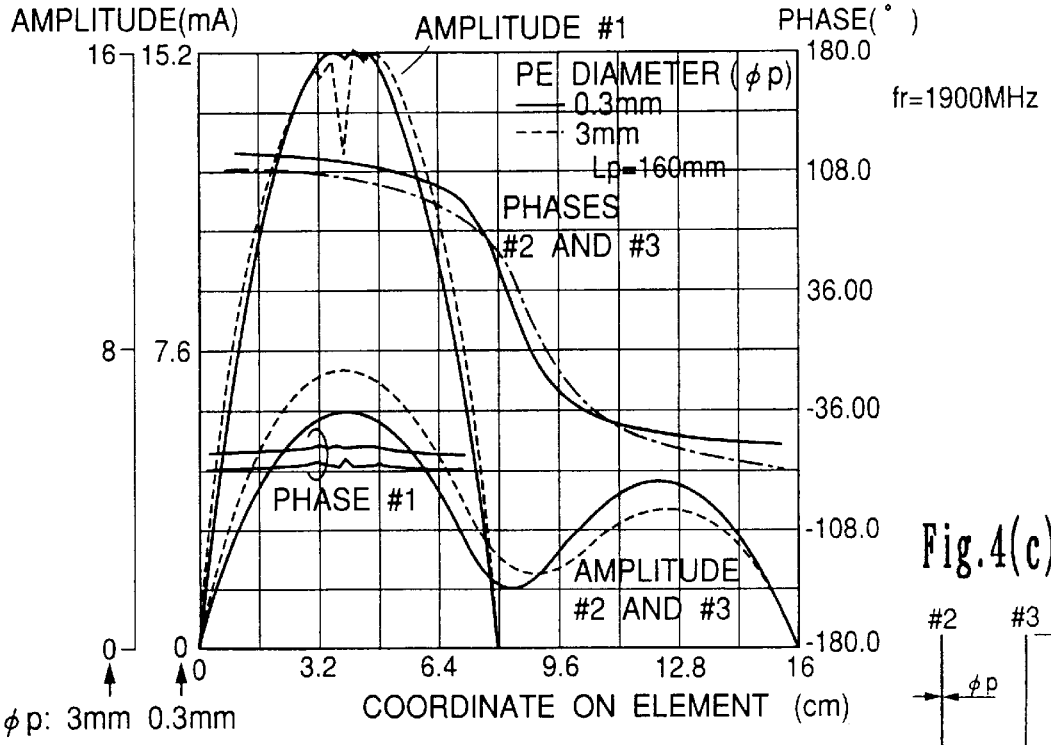
Fig.4(b) CURRENT DISTRIBUTIONS FOR DIFFERENT PE LENGTHS
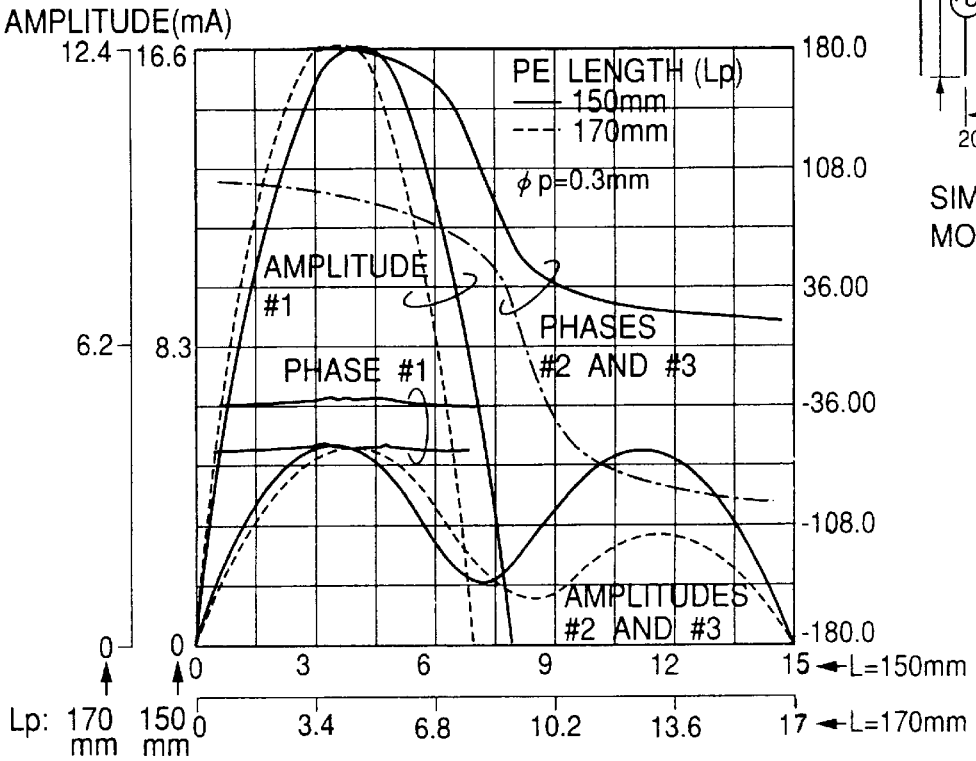
Fig.4(c)
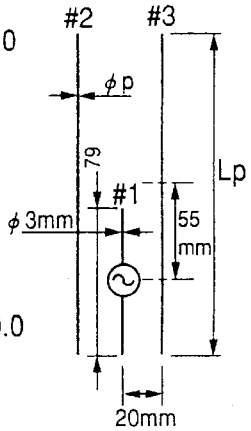
SIMULATION MODULE Fig. 5 MODEL ANTENNA
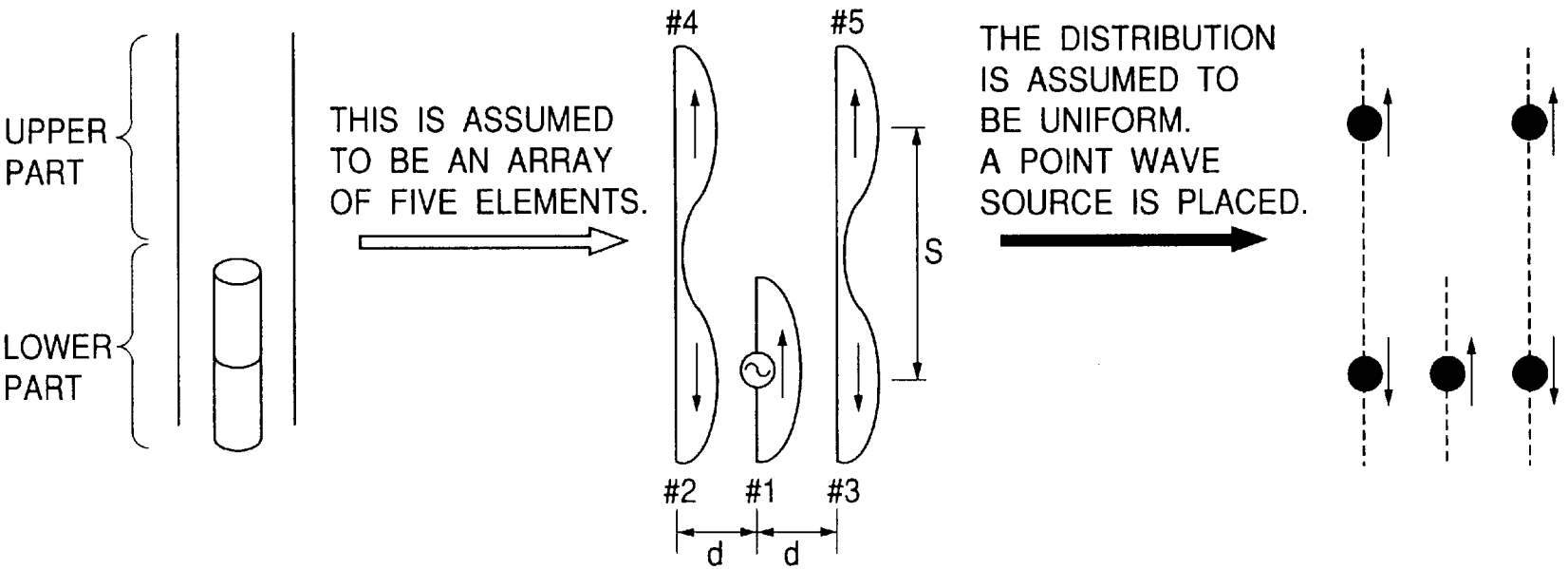

POINT WAVE SOURCE MODEL REGARDING DIRECTIONALITY IN HORIZONTAL PLANE

ARRAY FACTOR NO. 1
(HORIZONTAL PLANE)

ARRAY FACTOR NO. 2
(HORIZONTAL PLANE)

POINT WAVE SOURCE MODEL RELATED TO DIRECTIONALITY IN VERTICAL PLANE

Fig. 10
ARRAY FACTOR
(VERTICAL PLANE)
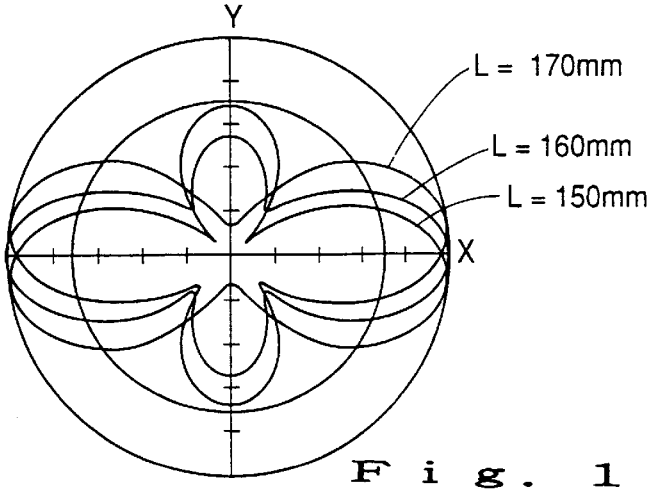
Fig. 11(a)
DIRECTIONALITY
CHANGES
CAUSED BY
COMBINATION
OF WAVE
SOURCES
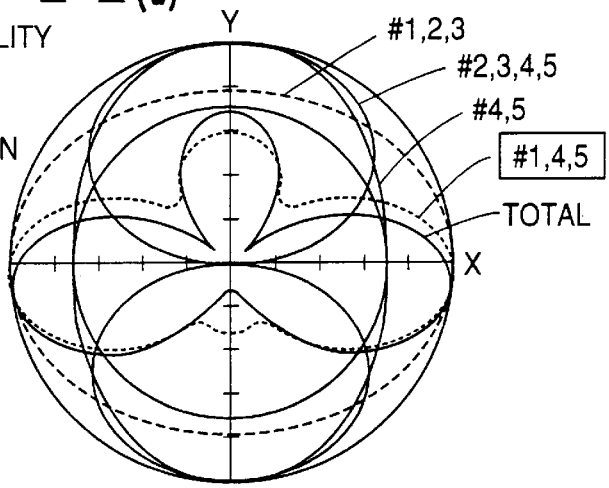
Fig. 11(b)
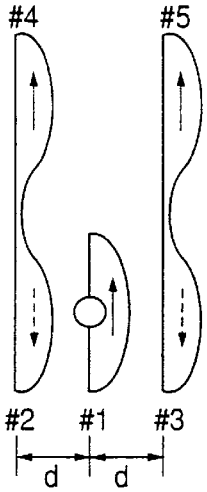
Fig. 12 PHASE DISTRIBUTION CHANGES CAUSED BY PE LENGTH L
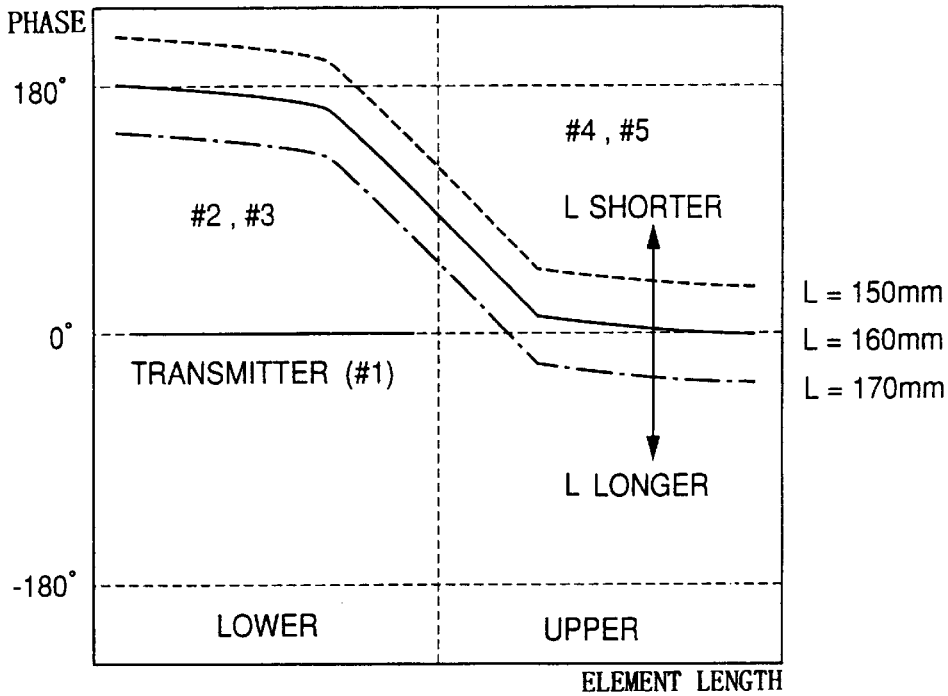

HORIZONTAL PLANE DIRECTIONALITY CHANGES WITH PE DIAMETER

BEAM TILT ANGLE CHANGES WITH THE PE LENGTH

PE offset 0.25λ PE length 1.01λ

PE diameter-average gain relationship as observed when distance between PEs and radiator is used as parameter PE diameter-directivity ripple relationship as observed when distance between PEs and radiator is used as parameter PE diameter-VSWR relationship as observed when distance between PEs and radiator is used as parameter PE offset 0.35λ PE length 1.01λ

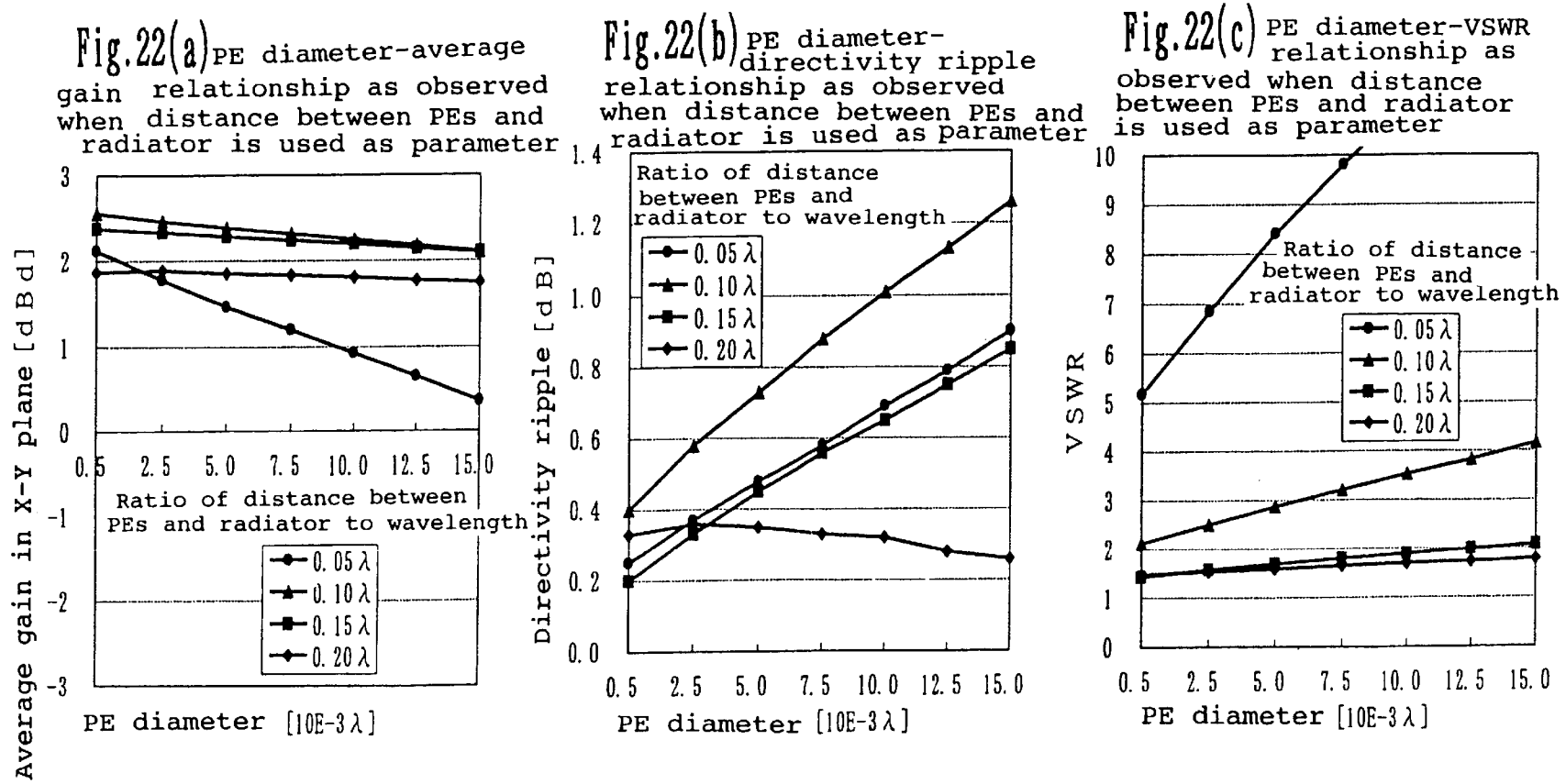

Fig.22(a) PE diameter-average gain relationship as observed when distance between PEs and radiator is used as parameter Fig.22(b) PE diameter-directivity ripple relationship as observed when distance between PEs and radiator is used as parameter Fig.22(c) PE diameter-VSWR relationship as observed when distance between PEs and radiator is used as parameter PE offset 0.5λ PE length 1.01λ

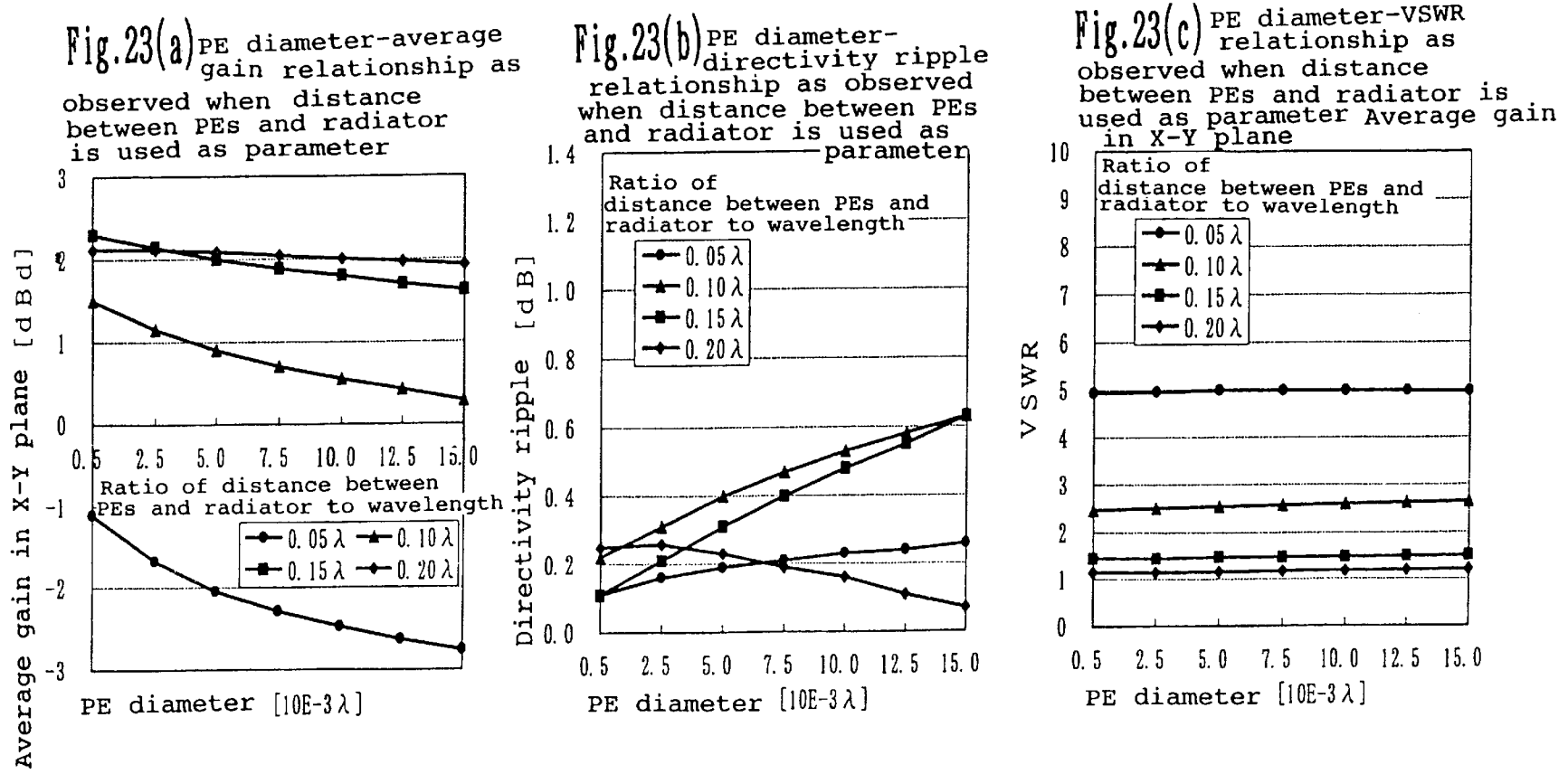

Fig.23(a) PE diameter-average gain relationship as observed when distance between PEs and radiator is used as parameter Fig.23(b) PE diameter-directivity ripple relationship as observed when distance between PEs and radiator is used as parameter Fig.23(c) PE diameter-VSWR relationship as observed when distance between PEs and radiator is used as parameter Average gain in X-Y plane d = 1cm, L = 6cm, S = 2cm
FREQUENCY = 1.9GHz

MOBILE RADIO ANTENNA

BACKGROUND OF THE INVENTION

1. Field of the Invention

The present invention relates to an antenna mainly used for a mobile radio, and more particularly, to a mobile radio antenna preferably used for a base station.

2.Related art of the Invention

In recent years, mobile radios, such as cellular phones and personal handyphone systems (hereinafter called PHSs), have been widely used. Many small base stations, especially for PHSs must be built, since its base stations and mobile stations have low power. Thus such base stations are required to be reduced in space.

Preferably, antennas for mobile radio base stations are as horizontally omnidirectional as possible because their mobile stations cannot be located. It is also preferable that their beam tilt angle can be set between zero and a few degrees in a vertical plane except for special antennas including indoor antennas and that their gain be high. FIG. 24 shows an example of such a conventional antenna for mobile radio base stations, a two-element co-linear array antenna. As shown in FIG. 24, a radome 115, which is nonconductive and housing an antenna consists of a radome top 115*a*, a radome bottom 115*b*, and a radome wall 115*c*, with a coaxial feeder 112 installed between radome top 115*a* and radome bottom 115*b*. A first dipole antenna 109 is formed with an internal conductor 112*a* above the coaxial feeder 112 and with a metal pipe 113, held by a spacer 114 made of an insulating material, such as Fluoride resin, and powered through an external conductor of the coaxial feeder 112. A second dipole antenna 110 is formed by symmetrically positioning metal pipes 113, held by spacers 114, above and below a circular slit 112X, provided around the external conductor of the coaxial feeder 112. The second antenna is powered through the circular slit 112X.

In the above arrangement, the first and second dipole antennas 109 and 110 are vertical, and the diagram representing its directivity in a horizontal plane is virtually round. The dipole antennas also have high directivity in a vertical plane and provides a desired gain because they are stacked vertically. For the arrangement, the beam tilt angle depends on the distance between the feeding points of the first and second dipole antennas 109 and 110. To tilt radiation beams from the arrangement down (or toward the −Z direction), the distance is reduced. To tilt the radio beams up (or toward the +Z direction), the distance is increased.

Although such conventional antennas have characteristics necessary for antennas for mobile radio base stations, their vertical dimension will be inevitably large. A conventional antenna must have a vertical dimension of about 177 mm for 1.9 GHz, for example. A vertical diversity antenna is as long as about 572 mm, assuming that the distance between its upper and lower antennas is 2.5λ (395 mm). Tilting beams from the antenna up causes it to become longer (its length increases from 177 to 191 mm when the tilt angle is set to +10°), thus limiting the location of its installation.

SUMMARY OF THE INVENTION

It is an object of the present invention to provide a mobile radio antenna by solving the problems with conventional antennas for mobile radio base stations, the mobile radio antenna allowing the mobile radio base station to be reduced in space while keeping the advantages of the station.

A mobile radio antenna of the present invention comprises:

a vertical dipole antenna having a feeding point;

a plurality of passive elements; and supporting means which is insulation and supports said dipole antenna and said plurality of passive elements so that each of said plurality of passive elements is virtually parallel to said vertical dipole antenna and the center of each of said plurality of passive elements differs in height from said feeding point by a predetermined distance, each of said plurality of passive elements being a line or strip conductor with an electrical length within ±10% of a wavelength used.

According to the present invention, disposing a plurality of passive elements with an electrical length within ±10% of a wavelength used so that their centers are at a predetermined distance from the feeding point of a vertical dipole antenna enables a mobile radio antenna with a small vertical dimension to be arranged which is omnidirectional in a horizontal plane, increases the gain vertical to the antenna axis in a vertical plane without the need for co-linear construction, and allows the tilt angle to be set between 0 and a few degrees. Moreover, according to the present invention, a mobile radio antenna can be reduced in height even when it is of vertical diversity construction.

BRIEF DESCRIPTION OF THE DRAWINGS

FIG. 4*a* shows current distributions for different PE diameters;

FIG. 4*b* shows current distributions for different PE lengths;

FIG. 4*c* shows a simulation model used for current distribution calculations;

FIG. 5 shows steps for simplifying the second antenna in FIG. 1 to a model;

FIG. 10 shows the results of calculations of the vertical plane array factor;

FIG. 11 shows directivity changes caused by different combinations of wave sources;

FIG. 12 shows phase distribution changes with parasitic element length;

FIGS. 15(*c*), 15(*d*), 15(*e*), and 15(*g*) are cross-sectional views illustrating the arrangements;

FIGS. 22(*a*)–22(*c*) are characteristic diagrams obtained by simulating the second embodiment of the mobile radio antenna with different passive elements diameters, with the passive element offset set to 7/20 of a wavelength used and the distance between the passive elements and the radiator as a parameter;

FIGS. 23(*a*)–23(*c*) are characteristic diagrams obtained by simulating the second embodiment of the mobile radio antenna with different passive elements diameters, with the passive element. offset set to ½ of a wavelength used and the distance between the passive elements and the radiator as a parameter;

FIG. 25(*b*) is a diagram illustrating the horizontal plane directivity of the conventional mobile radio antenna.

FIGS. 25(*c*) and 25(*d*) are diagrams illustrating the vertical plane directivity of the conventional mobile radio antenna.

DETAILED DESCRIPTION OF THE PREFERRED EMBODIMENTS

Figure 1:
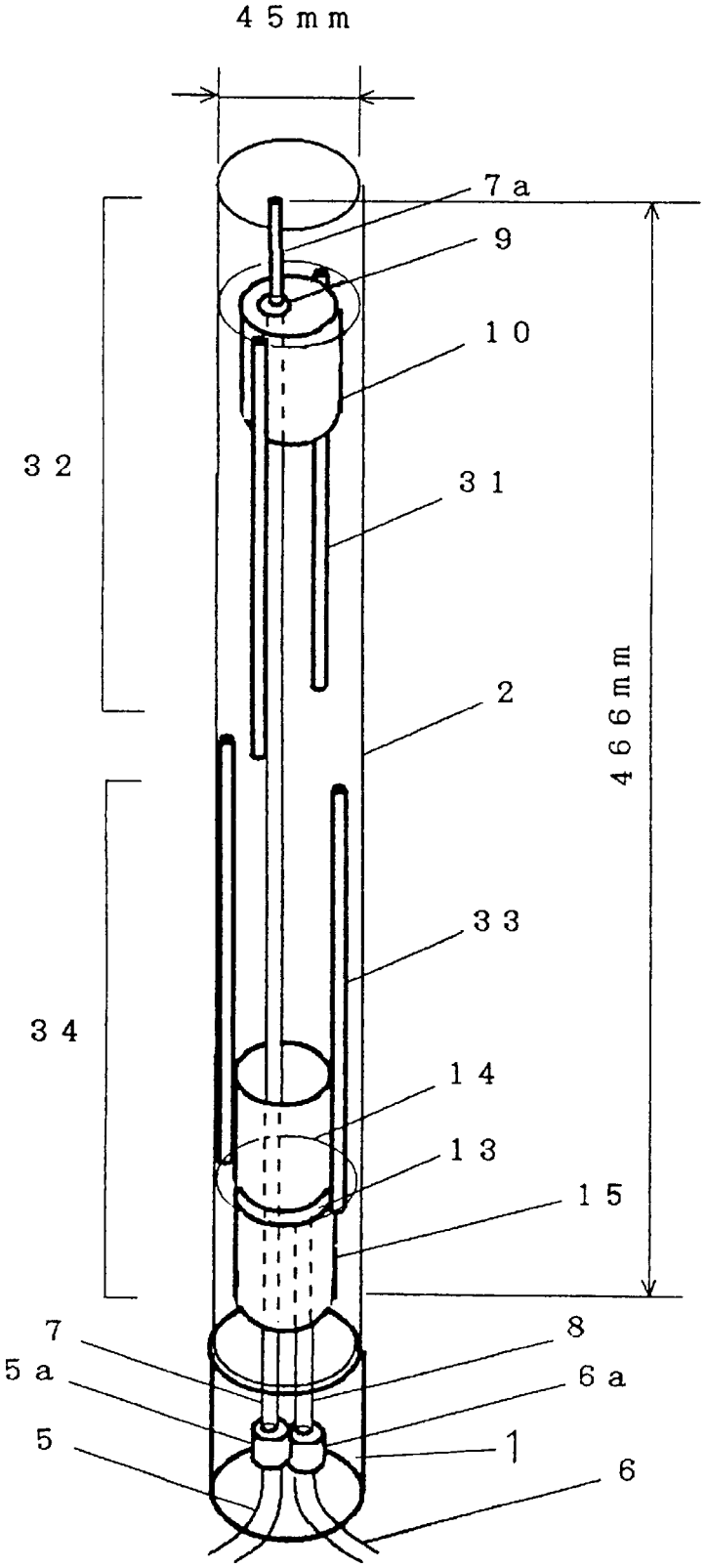
FIG. 1 is a perspective view of a first embodiment of a mobile radio antenna according to the present invention.

Referring now to the drawings, embodiments of a mobile radio antenna according to present invention are described below.

A mobile radio antenna comprises a vertical dipole antenna having a feeding point, a plurality of passive elements, and supporting means which are insulation and support the vertical dipole antenna and the plurality of passive elements so that each of the plurality of passive elements is virtually parallel to the vertical dipole antenna and that the center of each of the plurality of passive elements differs in height from the feeding point by a predetermined distance, each of the plurality of passive elements being a line or strip conductor with an electrical length within ±10% of a wavelength used.

This arrangement of the present invention provides a small mobile radio antenna which is omnidirectional in a horizontal plane and allows the tilt angle vertical to the antenna axis in a vertical plane to be reduced and the gain in a vertical plane to be increased without the need for co-linear array construction.

According to the present invention, the vertical dipole antenna and at least two of the plurality of passive elements can be arranged in a vertical line, with the advantages described above kept.

First Embodiment

Figure 2:
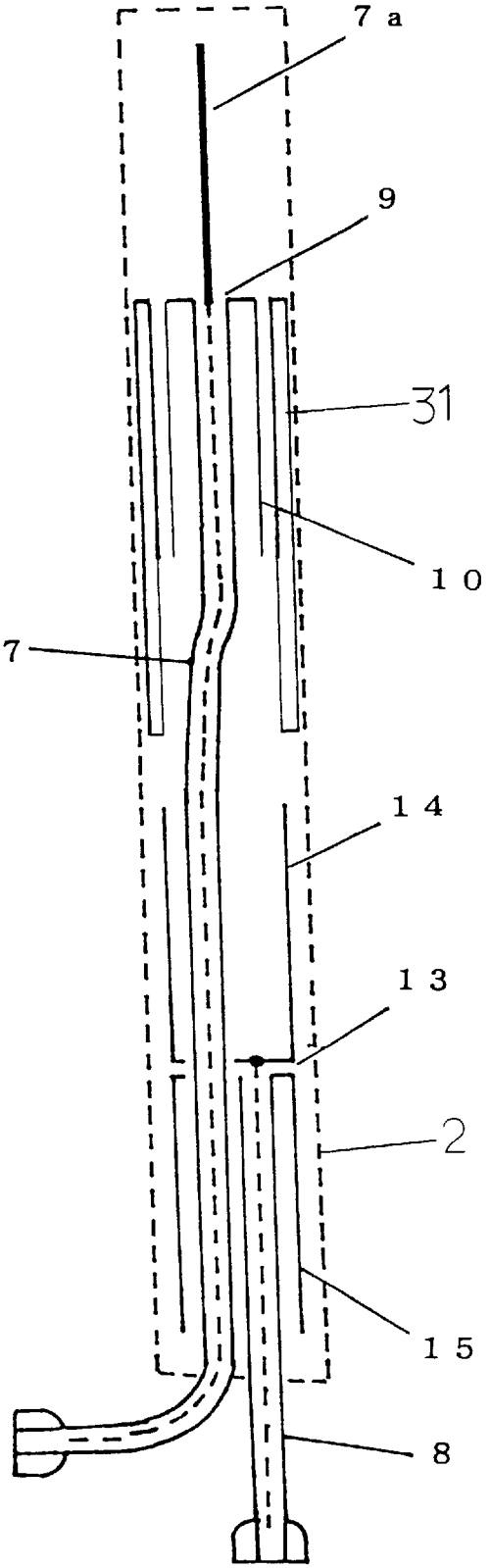
FIG. 2 is a cross-sectional view of the first embodiment of the mobile radio antenna.

FIG. 1 is a perspective view of a first embodiment of a mobile radio antenna according to the present invention, and FIG. 2 is a cross-sectional view of the first embodiment. As shown in FIG. 1, an antenna holder 1 holds a hollow nonconductive radome 2. Flexible coaxial feeders 5 and 6 connect in an antenna holder 1 rigid/flexible converters 5*a* and 6*a* with in-antenna rigid coaxial feeders 7 and 8, respectively. A first antenna 32 constitutes a dipole with a length of λ/2, using as radiators an internal conductor 7a with a length of about λ/4 at the upper end of the in-antenna coaxial feeder 7 and a metal pipe 10 with a length of about λ/4 connected with an external conductor at a feeding point 9. The first antenna is a sleeve antenna, with the metal pipe 10 as a sleeve. Two parasitic elements 31 (hereinafter called PEs), that is, passive elements installed inside the radome 2 as supporting means, are positioned near the first antenna 32 to be substantially parallel to the first antenna 32 and diametrically opposite to each other. The PEs 31 are conductors with an electrical length within ±10% of a wavelength used, whose centers positioned a predetermined distance below the feeding point 9.

Similarly, a second antenna 34 with a length of about λ/2 constitutes a dipole with a length of λ/2, using as radiators two metal pipes of the same length 14 and 15, fed at a feeding point 13 through the internal and external feeders of the in-antenna rigid coaxial feeder 8. Two PEs 33, that is, passive elements installed inside the radome 2 as supporting means, are positioned near the second antenna 34 to be substantially parallel to the second antenna 34 and diametrically opposite to each other. The PEs 33 are conductors with an electrical length within ±10% of a wavelength used, whose centers positioned a predetermined distance above the feeding point 13. That is, the upper ends of the upper passive elements and the lower ends of the lower passive elements are near the feeding points.

Exciting both antennas 32 and 34 of vertical diversity construction at the same frequency in the same phase increases the directivity and gain in a vertical plane because the antennas are stacked one on top of the other. Alternatively, the first and second antennas 32 and 34 can be used for two different frequency bands. Only one antenna may be used for a single frequency band.

As disclosed in the Japanese Patent Application No. 5-307846, the upper antenna 32 has a tilt angle for vertical plane directivity (see FIG. 25). As the PE length is increased beyond the length of the dipole, a radiator, in FIG. 1, the tilt angle (downward angle) gradually decreases from a negative value to zero, to a positive value (upward angle) as in FIG. 3. For general applications, a tilt angle within a range of ±10° is practically permissible. For best results, the PEs should be slightly moved up and down, starting at the PE position in FIG. 1. Thus the PE length can be set to within ±10% of a wavelength used, and the tilt angle can be changed by adjusting the PE length.

If the tilt angle is negative, the lower and upper passive elements are reversed in arrangement. Thus if the PE length is set so that the tilt angle of the lower antenna is positive when the tilt angle of the upper antenna is negative and the lower passive elements are arranged the same way as the upper passive elements, the tilt angle of the upper antenna can be set to almost the same negative value as that of the lower antenna.

According to the embodiment, providing at least two PEs with an electrical length within ±10% of a wavelength used above one end is substantially as high as the feeding point of a radiator at regular angles and at regular intervals enables a small mobile radio antenna to be arranged which is omnidirectional in a horizontal plane and allows the tilt angle to the antenna axis in a vertical plane to be reduced, thus increasing the vertical plane directivity gain without the need for co-linear array construction.

Referring now to the drawings, the operation of the first embodiment of the mobile radio antenna is described below.

Using the second antenna 34 in FIG. 1, simulation was performed by the moment method to calculate the current distribution over the dipole antenna and PEs. Based on the results, a horizontal plane omnidirectivity mechanism is described below which allows the tilt angle to be controlled only by adjusting PE length.

FIG. 4 shows the result of the calculations. Using solid and dotted lines, FIG. 4(*a*) shows current distributions for different PE diameters, which distributions were calculated with a trial antenna, and FIG. 4(*b*) shows current distributions for different PE lengths, which distributions were also calculated with the antenna. FIG. 4(*c*) shows the simulation model, which is arranged, assuming that the trial antenna is applied to a 1.9-GHz band. FIG. 4 indicates that the current on the PEs is reversed in phase at its center, that the PEs serve as a wavelength resonators because of two amplitude peaks, and that the current through radiator #1 and that through the PE bottom are reversed in direction. Thus the current over the PEs is schematically illustrated as in FIG. 5(*b*).

FIG. 5 illustrates the steps for simplifying the second antenna 34 in FIG. 1 to a model. As shown in the FIG. 5, the antenna is assumed to be an array of five elements, and current distribution is assumed to be uniform in terms of amplitude and phase. An isotropic point source is positioned at the loop of each current to find the array factor. Using this factor, the operation mechanism is discussed below.

First, the horizontal plane directivity is described.

Figure 6:
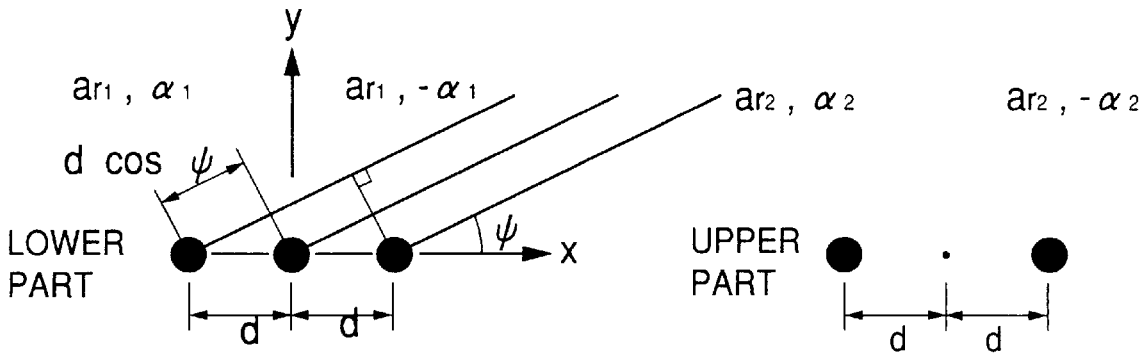
FIG. 6 shows an isotropic point source model related to horizontal directivity.

FIG. 6 shows the isotropic point source model, as viewed from the top of the antenna. The upper and lower array factors are as follows:

[Equation 1]

lower part $e_l = ar_1 \exp(-j\phi + j\alpha_1) + 1 + ar_1 \exp(j\phi + j\alpha_1)$ upper part $e_h = ar_2 \exp(-j\phi + j\alpha_2) + ar_2 \exp(j\phi + j\alpha_a)$ combination $e_t = e_l + e_h$ here $\phi = \beta d \cos\phi \beta = 2\pi/\lambda$ $ar_1$ and $ar_2$ represent the lower and upper current amplitudes, and $a_1$ and $a_2$ represent phases, with lower and upper PE radiators #1 used as references.

Figure 7:
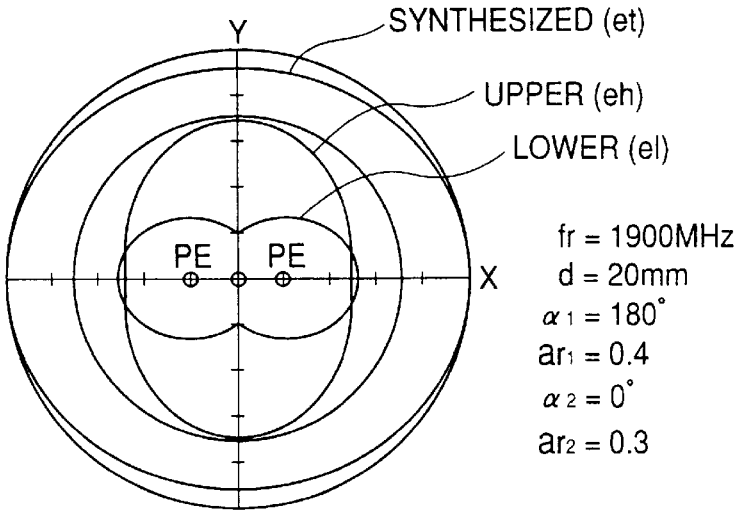
FIG. 7 shows the results of calculations of the horizontal plane array factor for a parasitic element radius of 0.15 mm.
Figure 8:
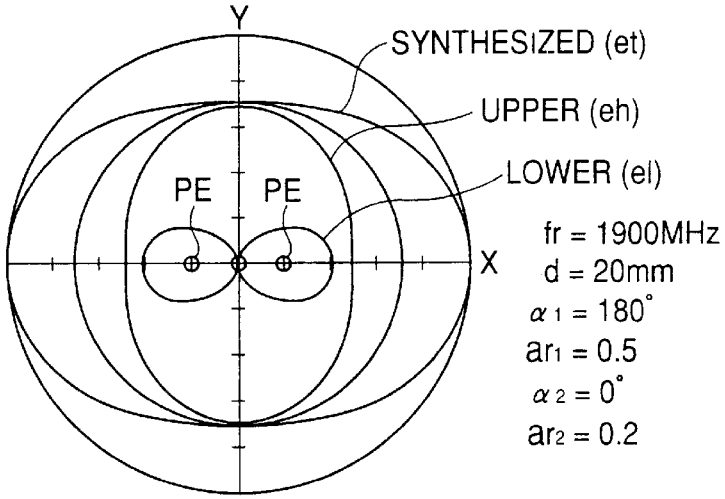
FIG. 8 shows the results of calculations of the horizontal plane array factor for a parasitic element radius of 1.5 mm.

FIGS. 7 and 8 show the results of array factor calculations. The results in FIG. 7 were obtained when current distribution parameters $a_1$=180°, $ar_1$=0.4, $a_2$ =0, and $ar_2$=0.3 as in FIG. 4(*a*) where the PE radius=0.15 mm and d=20 mm. FIG. 7 shows that the lower array factor ($e_1$) is strong in the direction of the antenna axis (X direction) and weak at right angles to the antenna axis (Y direction); that is, the directivity is represented by a cocoon-like diagram. This is because the PE current and radiator current are reversed in phase, thus prohibiting radiation in the Y direction. In contrast to the lower array factor, the upper array factor ($e_h$) is weak in the X direction and strong in the Y direction. That is, the upper direction of maximum radiation and the lower direction of maximum radiation are at right angles to each other. Thus the directivity ($e_t$), obtained by synthesizing these directionalities, is mostly zero. FIG. 4(*a*) also shows that synthesizing the directionalities increases the gain.

The results in FIG. 8 were obtained when current distribution parameters $ar_1$=0.5 and $ar_2$=0.2 as in FIG. 4(*a*) where the PE radius=1.5 mm. FIG. 4(*a*) shows that increasing the PE diameter increases the amplitude of the lower part of the PEs and reduces that of the upper part and that the radiator amplitude and the sum of the amplitude of two PEs become closer than in FIG. 8 (PE radius=0.15 mm) and cancel each other, thus reducing the lower array factor in terms of Y direction radiation. This in turn means that the synthesized directivity (et) becomes weak in the Y direction so that omnidirectionality is lost.

The above description of the horizontal plane omnidirectivity mechanism, or mechanism of directivity varying with the PE diameter, shows that PEs with a limited diameter are required to establish horizontal plane omnidirectivity.

Below is described vertical plane directivity.

Figure 9:
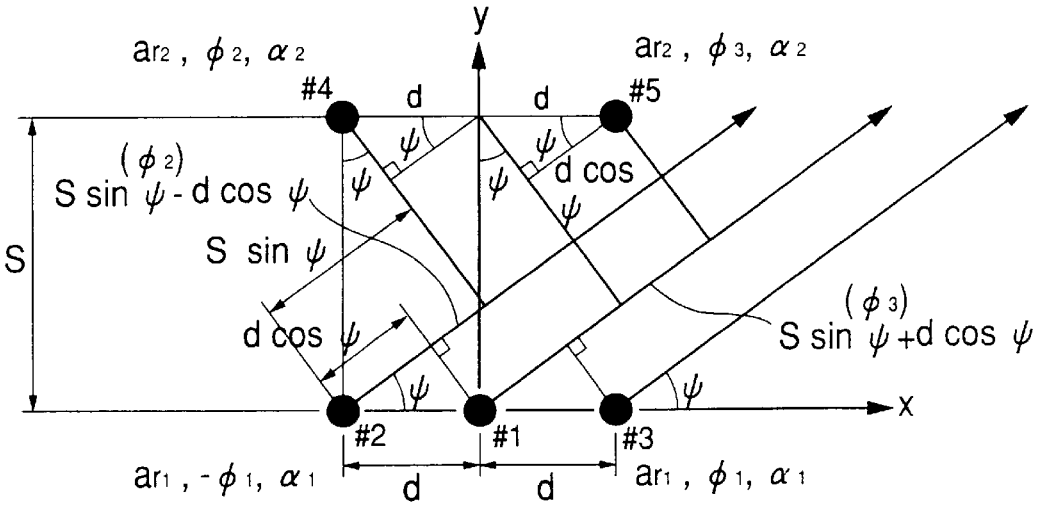
FIG. 9 shows an isotropic point source model related to vertical directivity.

As is the case with a horizontal plane, the array factor is found to discuss a beam tilt mechanism. FIG. 9 shows a vertical isotropic point source model. Wave source #1 represents a radiator; wave sources #2 and #3 are in the lower part of PEs; and wave sources #4 and #5 are in the upper part of the PEs. The wave sources in the upper and lower parts of the PEs are a distance S apart from each other. The array factor for this model is as follows:

[Equation 2]

$$e_t = \overset{\#2}{ar_1 \exp(-j\phi_1 + j\alpha_1)} + \overset{\#1}{1} + \overset{\#3}{ar_1 \exp(j\phi_1 + j\alpha_1)} + \underset{\#4}{ar_2 \exp(-j\phi_2 + j\alpha_2)} + \underset{\#5}{ar_2 \exp(j\phi_3 + j\alpha_2)}$$

here $$\phi_1 = \beta d \cos\phi \phi_2 = \beta(S \sin\phi - d \cos\phi)\ \phi_3 = \beta(S \sin\phi + d\cos\phi)\ \beta = 2\pi/\lambda$$

$ar_1$ and $ar_2$ represent the lower and upper current amplitudes, and $a_1$ and $a_2$ represent phases, with lower and upper PE radiators #1 as references.

From FIG. 4(*b*), current distribution parameters for different PE lengths were found as follows:

L=150 mm, $a_1$=200°, $ar_1$=0.3, $a_2$=20°, $ar_2$=0.3

L=160 mm, $a_1$=180°, $ar_1$=0.4, $a_2$=0°, $ar_2$=0.3

L=170 mm, $a_1$=160°, $ar_1$=0.3, $a_2$=−20°, $ar_2$=0.2

S=95 mm, d=20 mm, f=1,900 MHz

Figure 13:
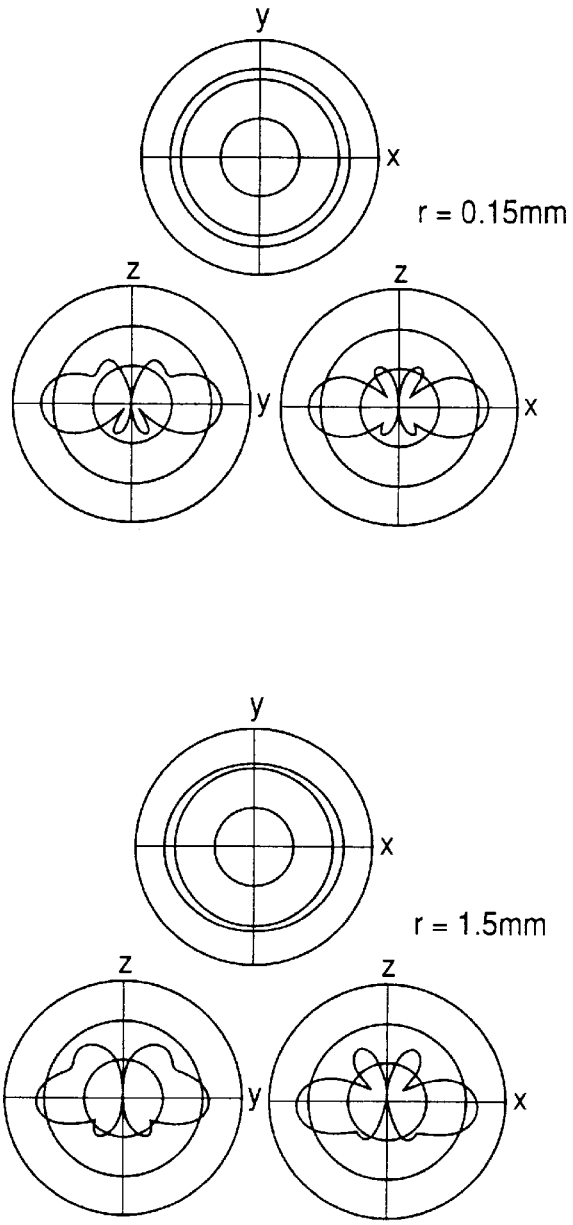
FIG. 13 shows horizontal directivity changes with the parasitic element diameter.
Figure 14:
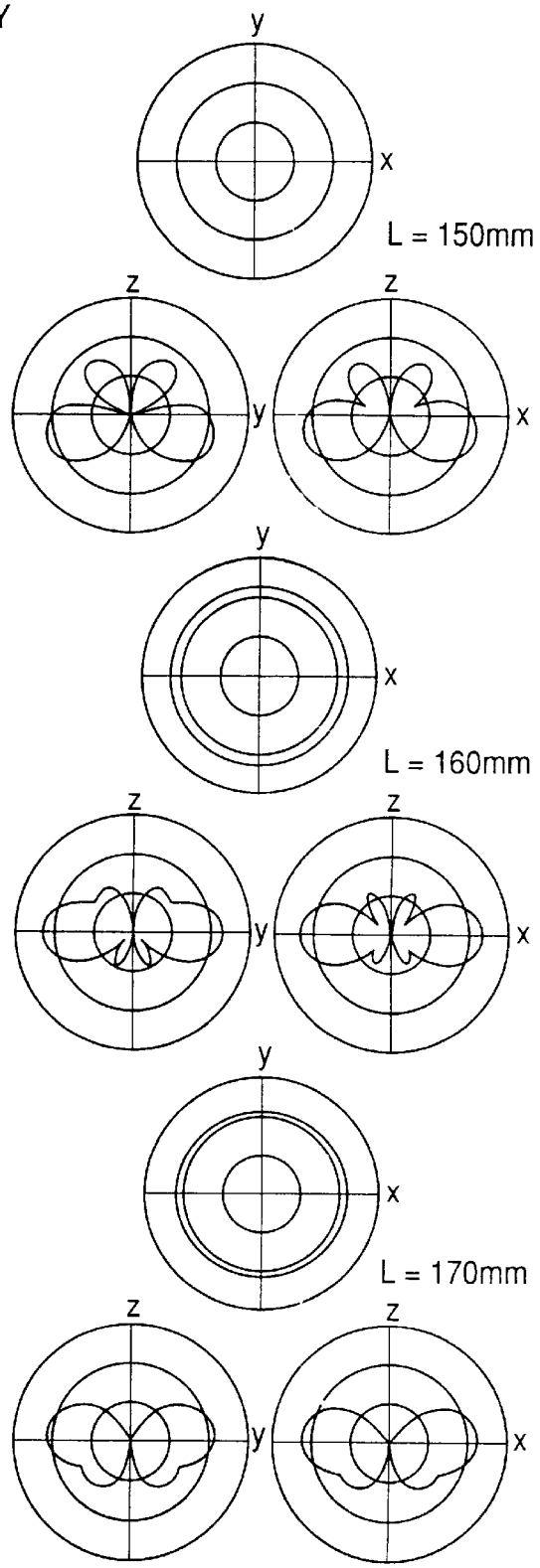
FIG. 14 shows beam tilt angle changes with parasitic element length.
Figure 15A:
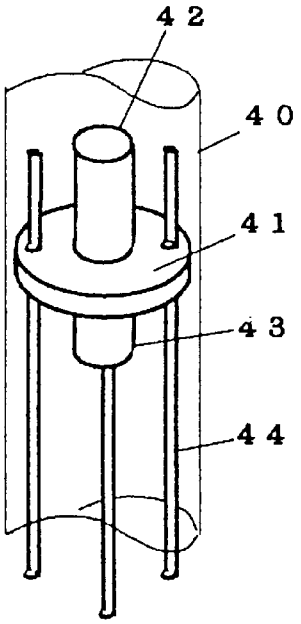
FIGS. 15(*a*), 15(*b*), and 15(*f*) are perspective views illustrating arrangements of passive elements in the first embodiment.
Figure 15B:
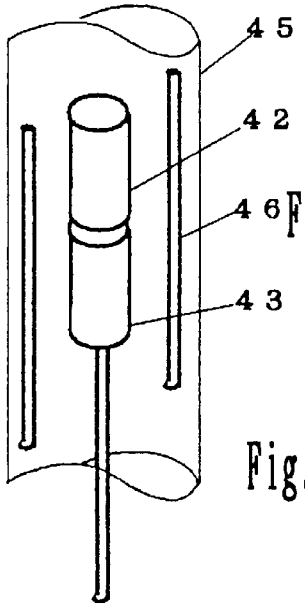
Figure 15C:
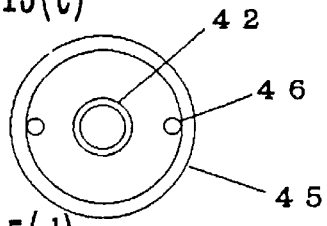
Figure 15D:
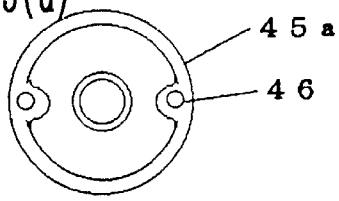
Figure 15E:
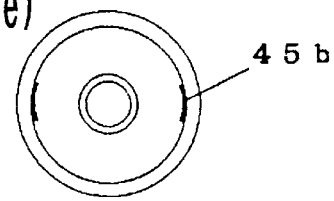
Figure 15F:
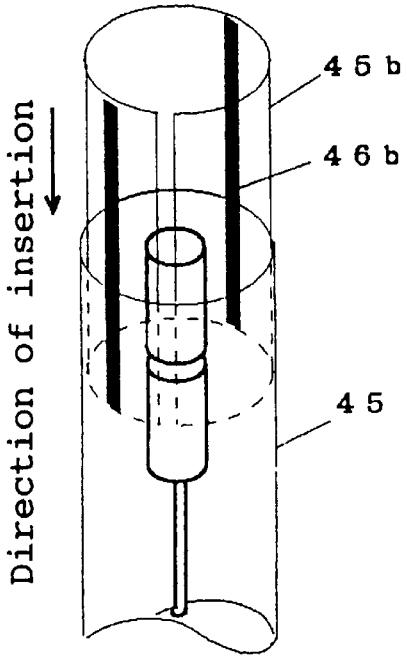
Figure 15G:
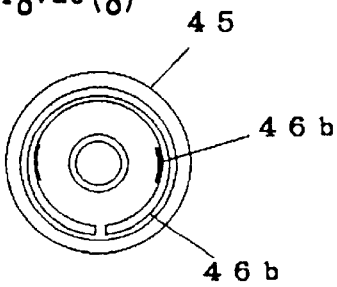

FIG. 10 shows the results of array. factor calculations from the above parameters. When L=160 mm, radiation is maximized horizontally (X direction), with the tilt angle=0°. The tilt angle is downward when L=150 mm, and it is upward when L=170 mm. These agree with the results obtained by the moment method (see FIGS. 13, 14, and 17). This shows that a simple isotropic point source model in FIG. 2 can be used to explain a beam tilt angle mechanism. Referring to FIG. 4(*b*), discussion is further made below.

FIG. 11 shows the results of array factor calculations for different combinations of the wave sources in FIG. 9, with L=150 mm. As shown in the FIG. 1, the directivity calculated using wave sources #1, #2, #3, that calculated using wave sources #4 and #5, and that calculated using wave sources #2, #3, #4, and #5 are horizontal or vertical. The directivity calculated using wave sources #1, #4, and #5, which is mostly the total directivity, clearly indicates the tilt condition. This shows that the beam tilt condition depends largely on the current phase of the radiator (wave source #1) and the upper part of the PEs (wave sources #4 and #5).

Taken together, the beam tilt mechanism is roughly explained as follows.

In FIG. 4(*b*), the phase distribution changes with the PE length, as shown in FIG. 12.

That is, the PE phase is ahead of the radiator phase when the length L is small, and it is behind the radiator phase when the length L is large. In such cases, the profile of the phase does not change, and the upper and lower parts differ in phase by about 180°. When L=160 mm, the current phases of the radiator and the upper part of the PEs agree with each other, and the synthesized directivity is horizontal. When L =150 mm, on the other hand, the directivity tilts down because the phase of the upper part of the PEs leads that of the radiator. Conversely, when L=170 mm, the directivity tilts up because the phase of the upper part of the PEs lags that of the radiator.

| PE length | Relationship of PE phase to radiator phase | Beam direction | Difference in phase between upper and lower parts of PE |
|---|---|---|---|
| L = 150 mm (0.95λ) | Leading | Tilted down | About 180° |
| L = 160 mm (1.01λ) | In phase | Horizontal | About 180° |
| L = 170 mm (1.08λ) | Lagging | Tilted up | About 180° |

This fact shows that the tilt angle can be adjusted only by changing the PE length. This means that the tilt angle can be kept constant by changing the PE length even if an antenna of diversity construction is inverted.

In the above embodiment, the input impedance is not always a target of around 50 ohms. However, it can readily be set to 50 ohms by matching.

FIG. 15 shows a method of forming PEs in the above embodiment. FIG. 15(*a*) shows an assembly made by inserting metal pipes 42 and 43, or radiators, and PEs 44 into a spacer 41 made of an insulating material, such as Fluoride resin, and inserting the spacer into a radome 40 or by forming the metal pipes and PEs integrally with the spacer and inserting the spacer into the radome. FIG. 15(*b*) shows an assembly made by installing PEs 46 in a radome 45. As shown in FIG. 15(*c*), or a cross-sectional view of the radome, wires or metal plates 46 may be applied. Alternatively, as shown in FIG. 15(*d*), the wires 46 may be formed integrally with a radome 45*a*. As shown in FIG. 15(*e*), a pattern 45*b* may be formed with a conductive material by printing or the like. To easily perform maintenance, the pattern is desirably formed on the internal surface of the radome, but it may be formed on its external surface. As shown in FIGS. 15(*f*) and 15(*g*), resin film 45*b*, on which a conductive pattern 46*b* is formed by printing or plating, may be inserted into, or fit over, the radome 45 to bond the film thereto.

The longer the distance between the feeding points of the upper and lower antennas (diversity distance), the lower the correlation between the antennas if vertical diversity construction is employed. Thus the diversity effect increases, but the antennas become longer. The arrangement of the embodiment allows the diversity distance to be increased when the antenna height is constant. As shown in FIG. 1, the antenna is about 466 mm long when the distance between the feeding points is 2.5λ (395 mm). The antenna is shorter than a conventional antenna system by 106 mm. Moreover, shifting the PEs of the upper and lower antennas 90° from each other in a horizontal plane lowers the correlation between the upper and lower antennas.

In FIG. 2, the in-antenna coaxial feeder 7 is curved so that it is positioned at the feeding point 9, that is, the center of the metal pipe 10, a radiator. As shown in FIG. 1, however, the feeder may extend straight up. Characteristic deterioration hardly occurs due to the eccentricity, that is, shift of the feeder from the center of the sleeve. The arrangement above facilitates manufacturing and reduces product variations and cost.

Below is described another embodiment of the present invention applied to a PHS frequency range from 1,895 to 1,920 MHz.

Second Embodiment

Figure 16:
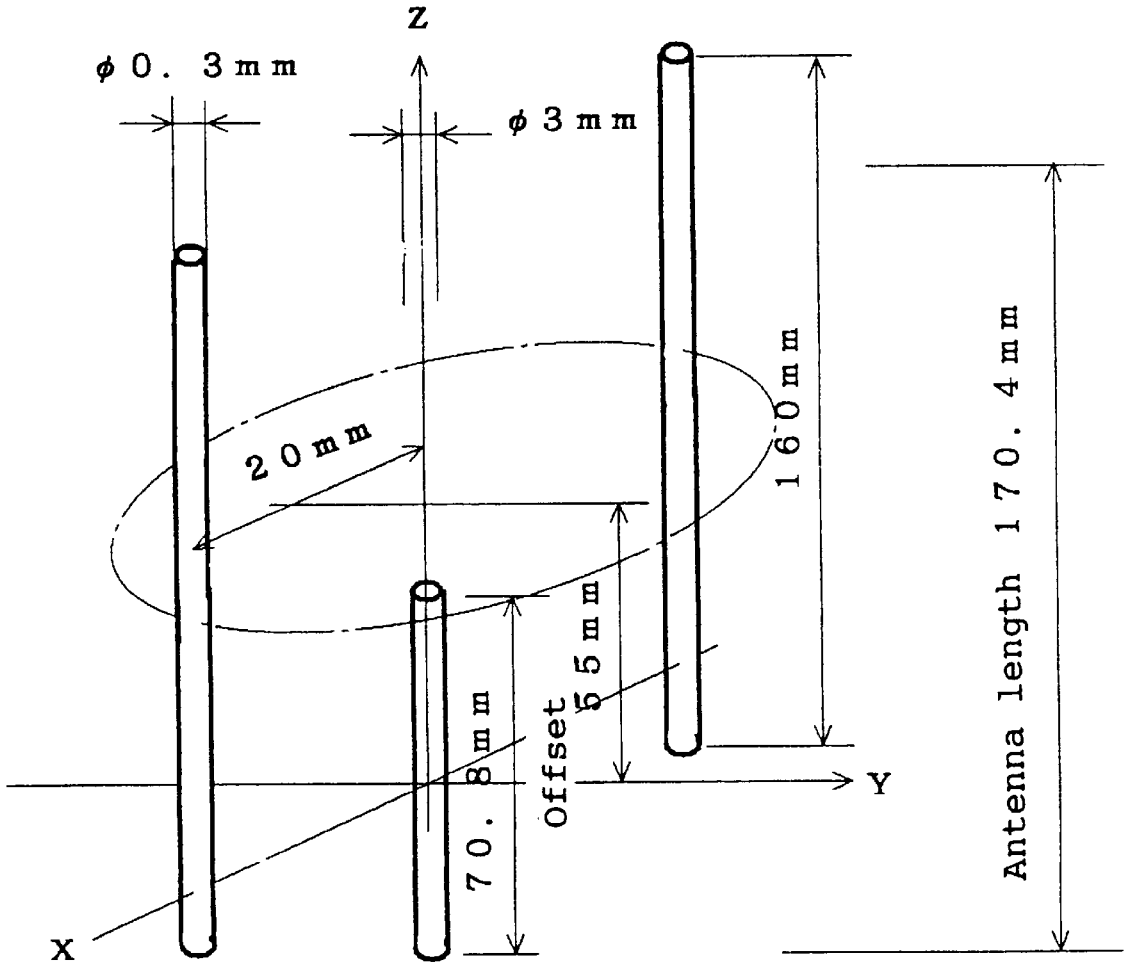
FIG. 16 is a perspective view illustrating an element arrangement in a second embodiment of a mobile radio antenna according to the present invention.
Figure 17A:
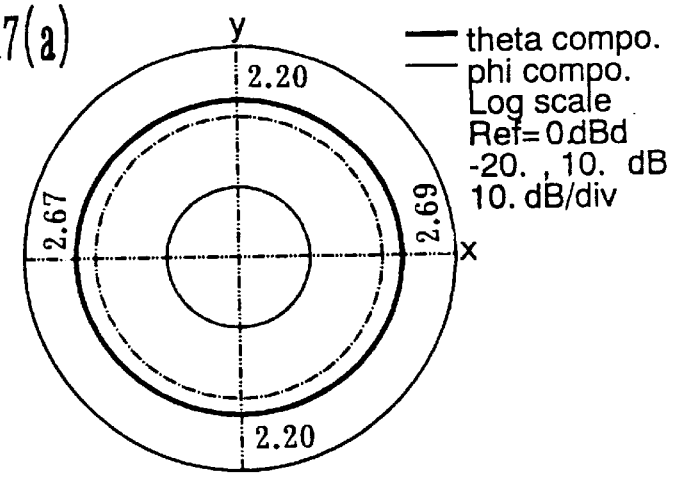
FIGS. 17(*a*)–17(*d*) are characteristic diagrams obtained by simulating the second embodiment of the mobile radio antenna.
Figure 17B:
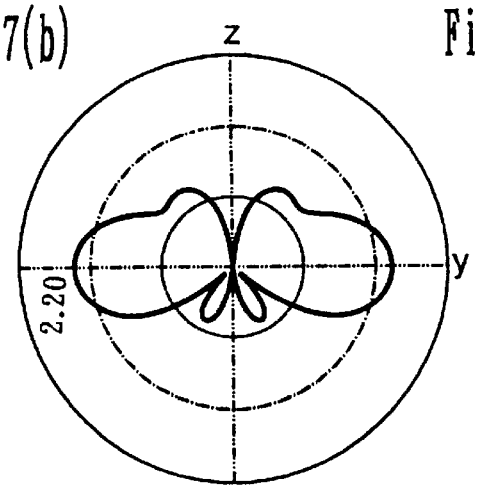
Figure 17C:
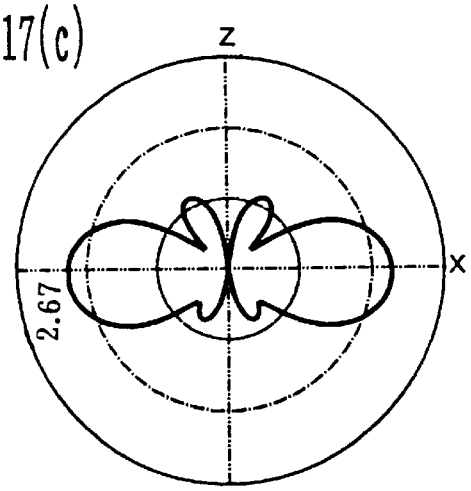
Figure 17D:
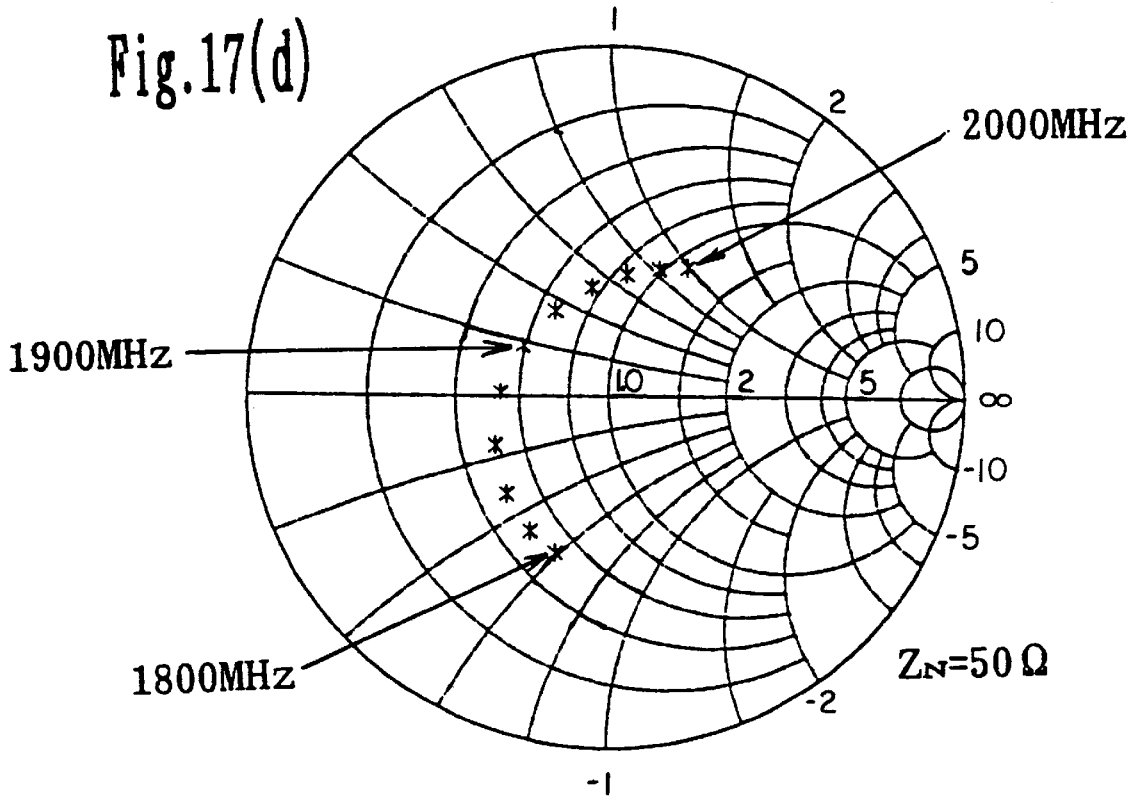

FIG. 16 shows a second embodiment of the present invention, formed with only one group of antennas. The embodiment is arranged so that its dimensions are determined as shown in FIGS., the radiator being 3 mm in outer diameter, and PEs being 0.3 mm in outer diameter. The antenna body is 170. 4 mm long and 40.3 mm in outer diameter except for antenna holders and the like. FIGS. 17(*a*) through 17(*d*) show characteristics of the embodiment calculated by the moment method using piecewise sinusoidal expansion functions and test functions. When settings were made so that the antenna system was not tilted, the maximum gain was 2.67 dBd, the average gain was 2.40 dBd, and the directivity ripple in a horizontal plane was 0.47 dB p-p at fr=1,900 MHz. Other parameters were Zin=29.6+j9.1Ω, $R_L$=11.1 dB, and SWR=1.78.

Figure 21A:
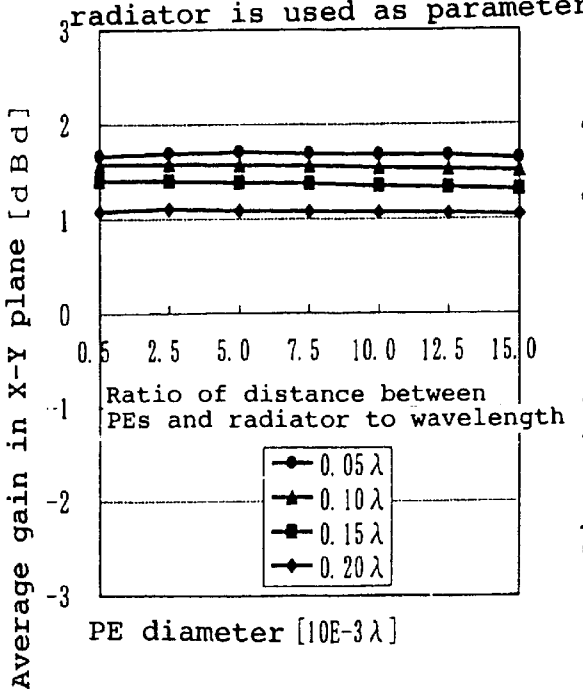
FIGS. 21(*a*)–21(*c*) are characteristic diagrams obtained by simulating the second embodiment of the mobile radio antenna with different passive elements diameters, with the passive element offset set to ¼ of a wavelength used and the distance between the passive elements and the radiator as a parameter.
Figure 21B:
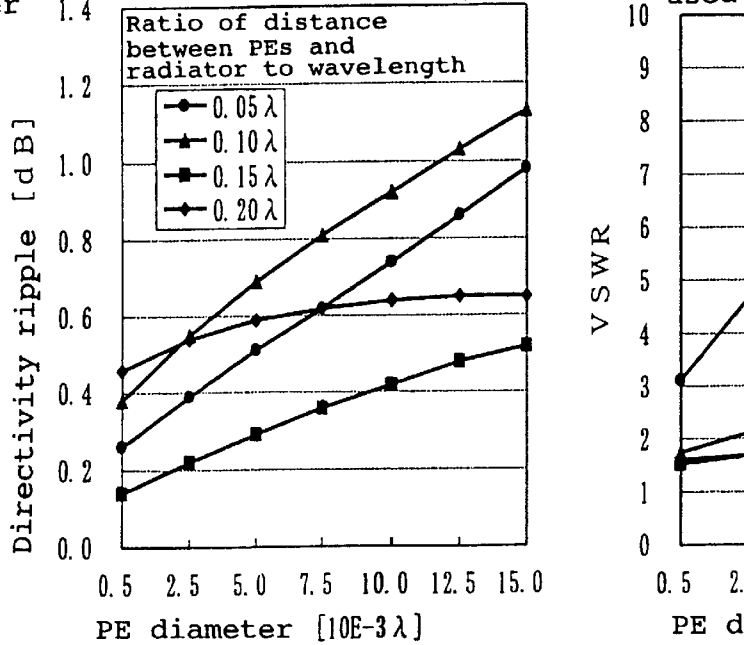

Using the arrangement of FIG. 16 basically having two PEs with different diameters, a simulation was made each for an PE offset of 0.251, 0.351, and 0.51 by the moment method. In the simulations, the distance between the PEs and the radiator was used as a parameter, and the PE length was maintained at 1.011 so that the beam tilt angle was zero. All data obtained is expressed using a wavelength used 1. FIGS. 21, 22, and 23 show the data for an PE offset of 0.251, 0.351, and 0.51, respectively.

Figure 3:
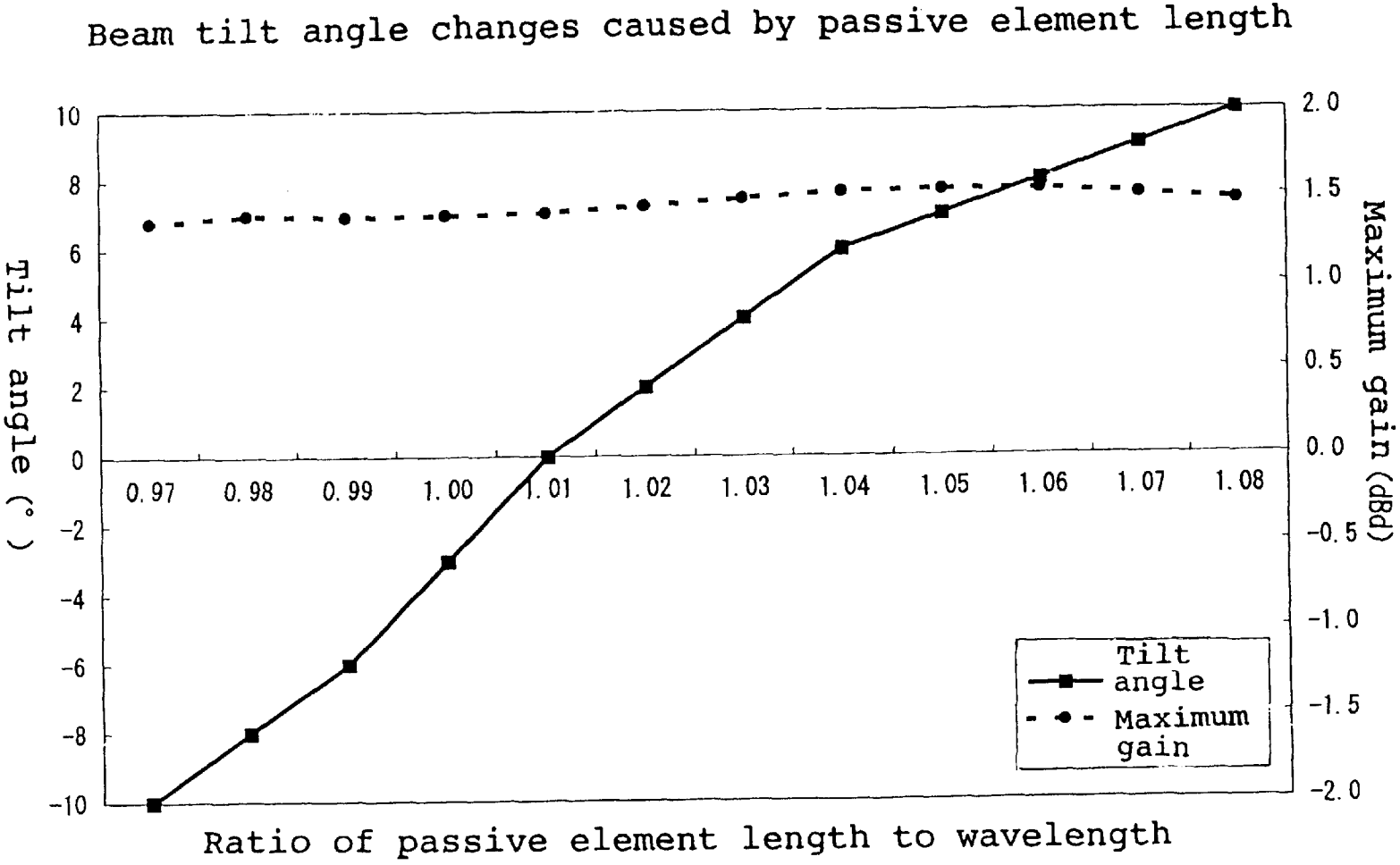
FIG. 3 is a characteristic curve of the tilt angle and maximum gain vs. the length of passive elements for the first embodiment.
Figure 21C:
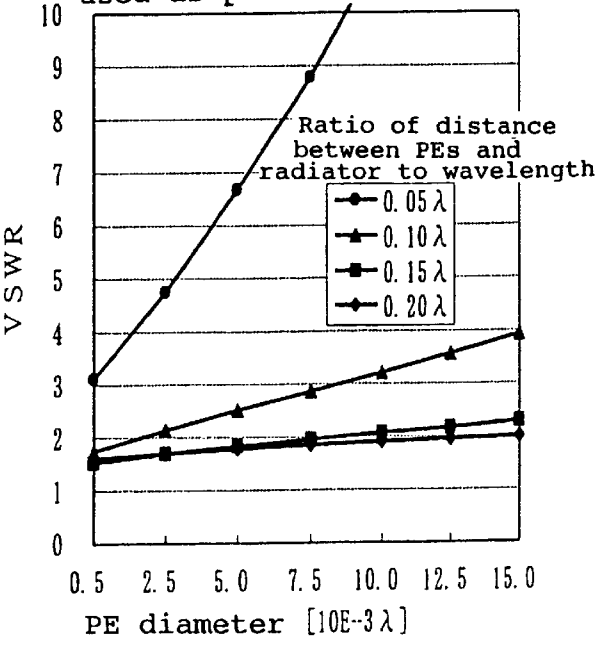
Figure 24:
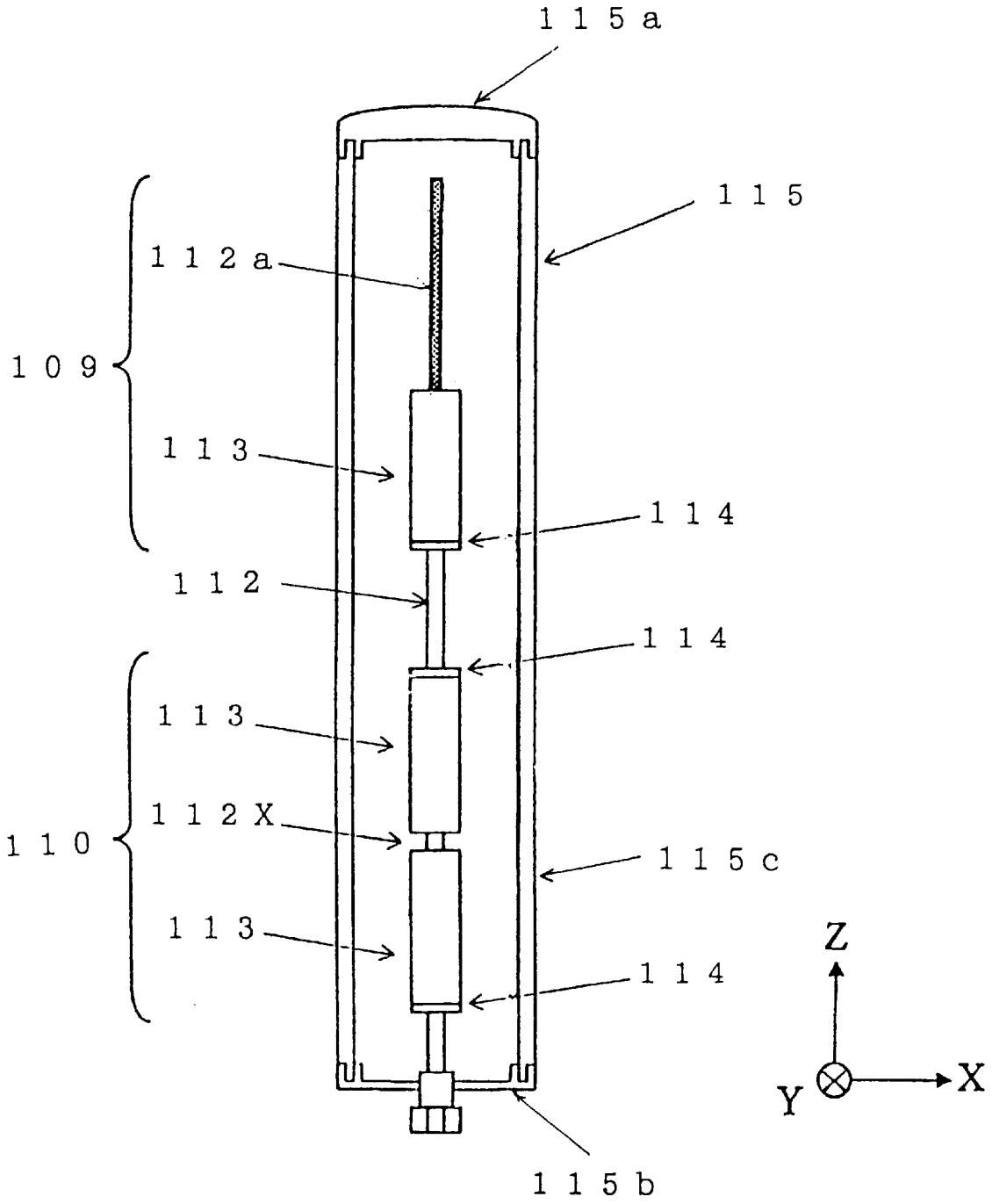
FIG. 24 is a cross-sectional side view of a conventional mobile radio antenna.
Figure 25A:
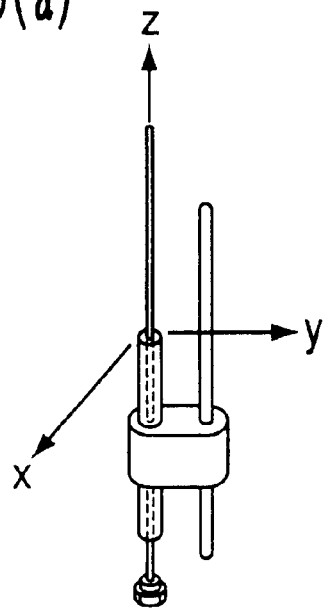
FIG. 25(*a*) is a perspective view of the conventional mobile radio antenna.
Figure 25B:
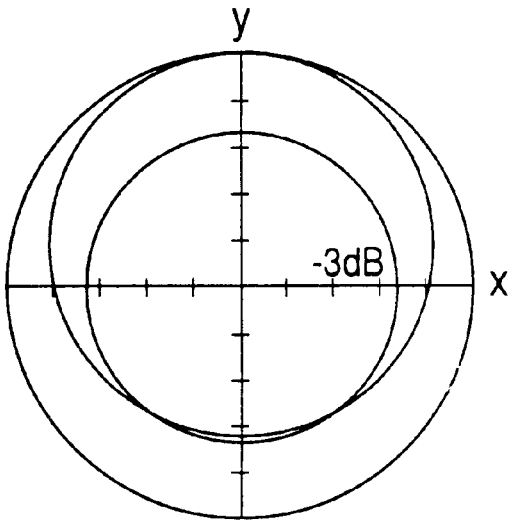
Figure 25C:
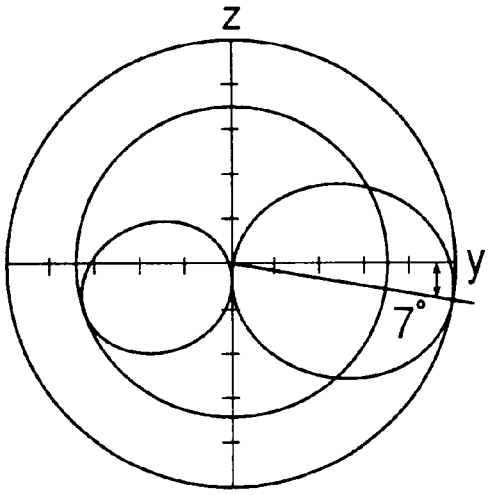
Figure 25D:
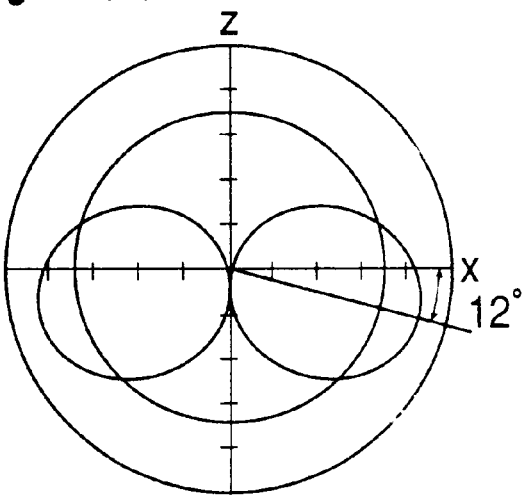

FIGS. 21(*a*), 22(*a*), and 23(*a*) show the relationship between the average gain in the X-Y plane (horizontal plane) and the PE diameter. When the PE offset is 0.351, a target average gain of 2 dBd or more can be obtained over a wide PE diameter range. FIGS. 21(*b*), 22(*b*), and 23(*b*) show the relationship between the PE diameter and the directivity ripple. These FIGS. provide an PE diameter range in which a target directivity ripple of 0.5 dB or less can be obtained under each condition. FIGS. 21(c), 22(*c*), and 23(*c*) show the relationship between the PE diameter and the VSWR. When the PE offset is 0.51, a target VSWR of 3 or less can be obtained over the most wide PE diameter range. If the PE diameter range is broadened to level down the target, it is practical to appropriately combine an PE diameter of 0.011 or less, an PE-radiator distance of 0.051 to 0.21, and a PE offset of 0.251 to 0.51. FIG. 3 finds that a practical PE length range in which a beam tilt angle of ±10° can be obtained is from 0.91 to 1.11.

Third Embodiment

Figure 18:
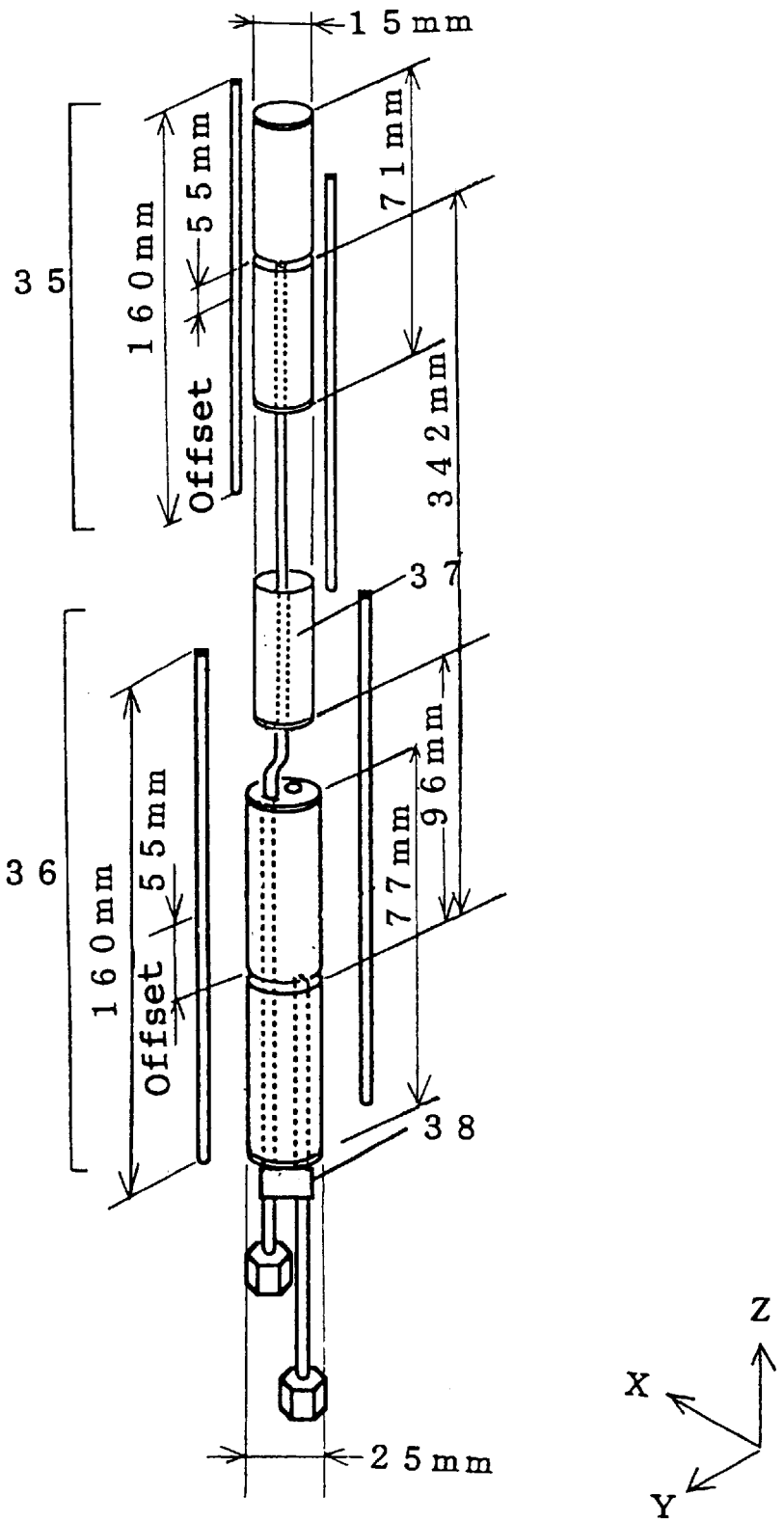
FIG. 18 is a perspective view of a third embodiment of a mobile radio antenna according to the present invention.
Figure 19A:
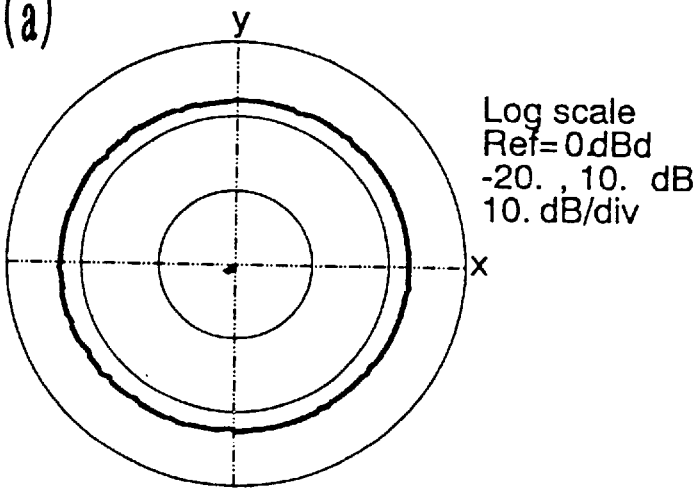
FIGS. 19(*a*)–19(*c*) are characteristic diagrams obtained by making measurements using the upper antenna of the third embodiment of the mobile radio antenna.
Figure 19B:
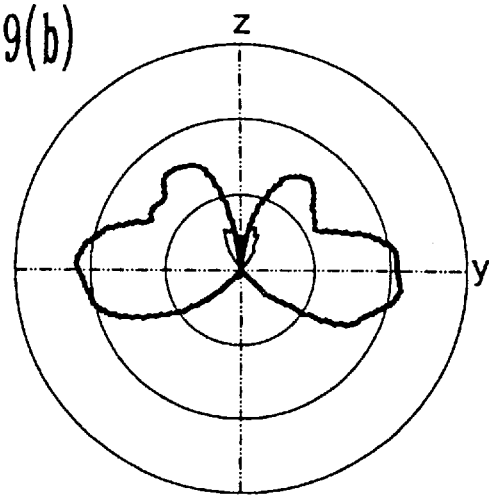
Figure 19C:
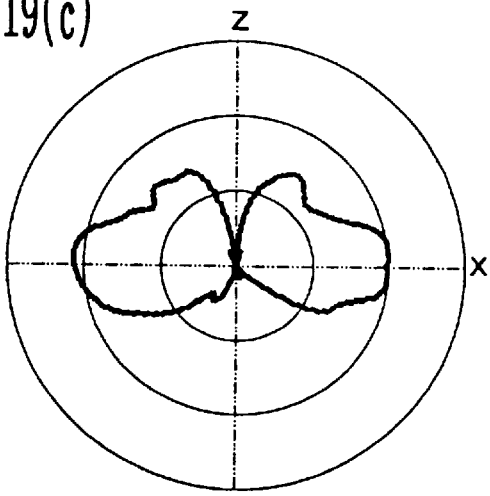

Simulations using a group of antennas have resulted in the second embodiment above. A third embodiment, an antenna consisting of upper and lower antennas, was made on a trial basis to make measurements. In the antenna of FIG. 18, based on the system of FIG. 1, a choke 37 is placed between a first upper antenna 35 and a second lower antenna 36 to satisfactorily isolate the upper antennas from the lower antennas, and the external conductors of the coaxial feeders of the first upper antenna and the second lower antenna are made to short-circuit each other using a conductor 38 to match the input impedance of the second lower antenna 36. Measurements in a PHS frequency range from 1,895 to 1,920 MHz showed that the maximum antenna gain is 2.97 dBd, the average gain is 2.53 dBd, and the VSWR is 1.38 or less. FIG. 19(*a*) shows the horizontal plane directivity of the upper antennas, and FIGS. 19(*b*) and 19(*c*) show the vertical plane directivity of the upper antennas.

Figure 20A:
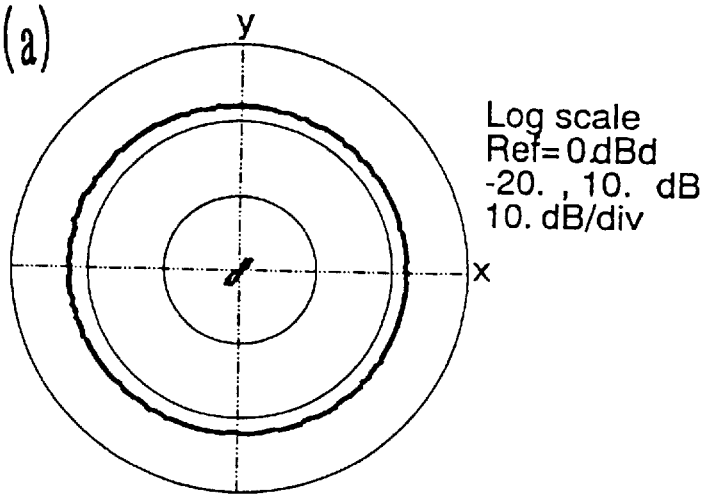
FIGS. 20(*a*)–20(*c*) are characteristic diagrams obtained by making measurements using the lower antenna of the third embodiment of the mobile radio antenna.
Figure 20B:
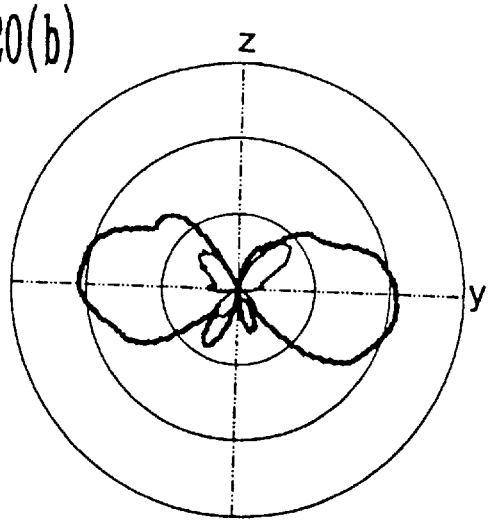
Figure 20C:
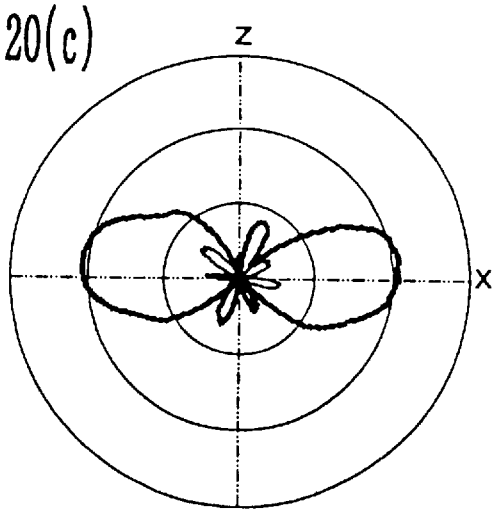

Measurements in a PHS frequency range from 1,895 to 1,920 MHz showed that the maximum antenna gain is 2.77 dBd for the lower-antenna, the average gain is 2.16 dBd, and the VSWR is 1.50 or less. FIG. 20(*a*) shows the horizontal plane directivity of the lower antennas, and FIGS. 20(*b*) and 20(*c*) show the vertical plane directivity of the lower antennas.

The third embodiment, consisting of two groups of antennas, provided similar measurements as did the second embodiment, consisting of one group of antennas.

The embodiments above have two passive elements but may contain more than two passive elements. When an embodiment has more than two passive elements, a diagram representing the horizontal plane directivity becomes more circular, thus allowing the embodiment to be reduced in size.

In the embodiments above, two groups of antennas are also disposed vertically. The number of groups of antennas disposed vertically, however, is not limited to two. More than two groups of antennas may be of course installed.

As described above, according to the present invention a small mobile radio antenna can be arranged which is omni-directional in a horizontal plane and allows the tilt angle to the antenna axis in a vertical plane to be freely set between +100 to −10° by adjusting the PE length, thus increasing the vertical plane directivity gain without the need for co-linear array construction.

An antenna according to the present invention can be arranged so that at least two combinations of a vertical dipole antenna and a plurality of passive elements are disposed one on top of the other in a vertical direction, with the advantaged above kept.

What is claimed is:

1. A mobile radio antenna comprising:

a vertical dipole antenna having a feeding point;

a plurality of passive elements; and supporting means which is insulating and supports said dipole antenna and said plurality of passive elements so that each of said plurality of passive elements is virtually parallel to said vertical dipole antenna and the center of each of said plurality of passive elements differs in height from said feeding point by a predetermined distance, each of said plurality of passive elements being a line or strip conductor with an electrical length within ±10% of a wavelength used, and wherein a plurality of combinations of said vertical dipole antenna, said plurality of passive elements, and said supporting means are each disposed vertically, such that the center of each of said plurality of passive elements, which are included in the top of said plurality of combinations, is said predetermined distance below said feeding point included in said top combination, and the center of each of said plurality of passive elements, which are included in the bottom of said plurality of combinations, is said predetermined distance above said feeding point included in said bottom combination.

2. A mobile radio antenna according to claim 1, wherein said vertical dipole antenna is among said plurality of passive elements, the horizontal distance between each of said plurality of passive elements and said vertical dipole antenna is equal to 1/20 to 1/5 of a wavelength used, and said predetermined distance is equal to 1/4 to 1/2 of the wavelength used.

3. A mobile radio antenna according to claim 2, wherein a plurality of combinations of said vertical dipole antenna, said plurality of passive elements, and said supporting means are each disposed vertically.

4. A mobile radio antenna according to claim 1, wherein the beam tilt angle of each of said plurality of combinations is set downward.

5. A mobile radio antenna according to claim 4, wherein the horizontal disposition of said plurality of passive elements included in said plurality of combinations differs from combination to combination.

6. A mobile radio antenna according to claim 1, wherein the horizontal disposition of said plurality of passive elements included in said plurality of combinations differs from combination to combination.

7. A mobile radio antenna according to claim 1, wherein the external conductors of coaxial feeders for said vertical dipole antenna belonging to each of said plurality of combinations short-circuit each other.

8. A mobile radio antenna according to claim 1, wherein said supporting means have a protecting section parallel to said vertical dipole antenna, and each of said plurality of passive elements is applied to the surface of the protecting section.

9. A mobile radio antenna according to claim 1, wherein said supporting means have a protecting section parallel to said vertical dipole antenna, and each of said plurality of passive elements is formed inside the protecting section.

10. A mobile radio antenna according to claim 1, wherein said supporting means have a protecting section parallel to said vertical dipole antenna, and each of said plurality of passive elements is formed on the protecting section by printing.

11. A mobile radio antenna according to claim 1, wherein said supporting means have a plurality of protecting sections disposed at regular intervals in parallel with said vertical dipole antenna, each of said plurality of passive elements is a conductor formed on insulation film by printing or plating and inserted into, or applied to, each of said plurality of protecting sections.

12. A mobile radio antenna, comprising:

a vertical dipole antenna for transmitting at a wavelength, the vertical dipole antenna having a feeding point;

a plurality of passive elements, each of said passive elements being formed from a line or strip conductor and having an electrical length within ±10% of the wavelength; and an insulative support for supporting the vertical dipole antenna and the plurality of passive elements such that each of the passive elements is substantially parallel to the vertical dipole antenna and the center of each of the passive elements differs in height from the feeding point of the vertical dipole antenna by a predetermined vertical distance.

13. A mobile radio antenna according to claim 12, wherein a horizontal distance between the vertical dipole antenna and each of the passive elements is from 1/20 to 1/5 of the wavelength.

14. A mobile radio antenna according to claim 13, wherein the predetermined vertical distance is from 1/4 to 1/2 of the wavelength.

15. A mobile radio antenna according to claim 12, wherein the predetermined vertical distance is from 1/4 to 1/2 of the wavelength.

16. A mobile radio antenna according to claim 12, wherein the support has a protecting section parallel to the vertical dipole antenna, and each of the passive elements is applied to a surface of the protecting section.

17. A mobile radio antenna according to claim 12, wherein the support has a protecting section parallel to the vertical dipole antenna, and each of the passive elements is formed inside of the protecting section.

18. A mobile radio antenna according to claim 12, wherein the support has a protecting section parallel to the vertical dipole antenna, and each of the passive elements is formed on the protecting section by printing.

19. A mobile radio antenna according to claim 12, wherein the support has a plurality of protecting sections disposed at regular intervals parallel to the vertical dipole antenna, and each of the passive elements is a conductor formed by printing or plating, and each of the passive elements is inserted into or applied to one of protecting sections.

20. A mobile radio antenna system, comprising a plurality of mobile radio antennas as recited in claim 12 disposed in a vertical direction such that the mobile radio antenna system includes a top mobile radio antenna and a bottom mobile radio antenna.

21. A mobile radio antenna system as recited in claim 20, wherein the vertical dipole antenna of the top mobile radio antenna and the vertical dipole antenna of the bottom mobile radio antenna are integrally formed.

22. A mobile radio antenna system as recited in claim 20, wherein a center of each of the passive elements of the top mobile radio antenna is positioned below the feeding point of the top mobile radio antenna by the predetermined vertical distance, and a center of each of the passive elements of the bottom mobile radio antenna is positioned above the feeding point of the bottom mobile radio antenna by the predetermined vertical distance.

23. A mobile radio antenna system as recited in claim 22, wherein a beam tilt angle of each of the mobile radio antennas is set downward.

24. A mobile radio antenna system as recited in claim 20, wherein a beam tilt angle of each of the mobile radio antennas is set downward.

25. A mobile radio antenna system as recited in claim 20, wherein a horizontal disposition of each passive element in each of the mobile radio antennas differs between each of the mobile radio antennas.

26. A mobile radio antenna system as recited in claim 20, wherein external conductors of coaxial feeders for each of the vertical dipole antennas short circuit the other external conductors of coaxial feeders of the other vertical dipole antennas.

* * * * *